US010533361B2

(12) United States Patent
Tsui et al.

(10) Patent No.: US 10,533,361 B2
(45) Date of Patent: Jan. 14, 2020

(54) WIRELESS INFRARED SAFETY SENSOR FOR GARAGE DOOR OPENER SYSTEM

(71) Applicants: Philip Y. W. Tsui, Hong Kong (CN); Gallen K. L. Tsui, Brampton (CA)

(72) Inventors: Philip Y. W. Tsui, Hong Kong (CN); Gallen K. L. Tsui, Brampton (CA)

( * ) Notice: Subject to any disclaimer, the term of this patent is extended or adjusted under 35 U.S.C. 154(b) by 13 days.

(21) Appl. No.: 15/746,194

(22) PCT Filed: Jul. 14, 2016

(86) PCT No.: PCT/CA2016/050832

§ 371 (c)(1),
(2) Date: Jan. 19, 2018

(87) PCT Pub. No.: WO2017/008167

PCT Pub. Date: Jan. 19, 2017

(65) Prior Publication Data

US 2018/0216389 A1 Aug. 2, 2018

Related U.S. Application Data

(60) Provisional application No. 62/192,731, filed on Jul. 15, 2015.

(51) Int. Cl.
*E05F 11/00* (2006.01)
*E05F 15/40* (2015.01)
(Continued)

(52) U.S. Cl.
CPC ..... *E05F 15/40* (2015.01); *E05F 15/73* (2015.01); *E05F 15/78* (2015.01); *G07C 9/00309* (2013.01); *E05F 15/668* (2015.01); *E05F 2015/765* (2015.01); *E05Y 2201/434* (2013.01); *E05Y 2400/32* (2013.01); *E05Y 2400/44* (2013.01); *E05Y 2400/45* (2013.01); *E05Y 2400/54* (2013.01); *E05Y 2900/106* (2013.01);
(Continued)

(58) Field of Classification Search
CPC . E05F 15/40; E05F 15/43; E05F 15/78; E05F 15/73; E05F 15/77; E05F 15/668; E05F 2015/435; E05F 2015/436; E05Y 2400/32; E05Y 2400/54; E05Y 2900/106; G07C 2009/00928
USPC ..... 49/197, 199, 25
See application file for complete search history.

(56) References Cited

U.S. PATENT DOCUMENTS 5,942,988 A 8/1999 Snyder et al.
5,969,637 A * 10/1999 Doppelt ..... G07C 9/00817 318/266
(Continued)

FOREIGN PATENT DOCUMENTS

CA 2854641 5/2013

*Primary Examiner* — Jerry E Redman

(57) ABSTRACT

The invention relates generally to the field of motorized garage door openers. In particular, the invention relates to wireless safety sensors for garage door openers and garage door opener with a wireless safety sensor. The wireless safety sensor has a wireless communication link with a main control unit of the garage door opener. The wireless safety sensor also has an internal wireless link, i.e., a detection beam link, between a master unit and a slave unit. The wireless safety sensor periodically verifies that the wireless communication link has good signal quality and maintains the quality of the wireless communication link.

34 Claims, 8 Drawing Sheets

(51) Int. Cl.

| | |
|---|---|
| ***E05F 15/73*** | (2015.01) |
| ***E05F 15/78*** | (2015.01) |
| ***G07C 9/00*** | (2006.01) |
| *E05F 15/668* | (2015.01) |

(52) U.S. Cl.
CPC ..... *G07C 2009/00769* (2013.01); *G07C 2009/00928* (2013.01)

(56) References Cited

U.S. PATENT DOCUMENTS

| | | | | |
|---|---|---|---|---|
| 6,915,146 | B1 * | 7/2005 | Nguyen | G07C 9/00182 340/12.51 |
| 8,330,572 | B2 * | 12/2012 | Rodriguez | G07C 9/00182 340/13.28 |
| 9,756,233 | B2 * | 9/2017 | Lee | H04N 5/23203 |
| 10,087,673 | B1 * | 10/2018 | Rosenmarkle | E05F 15/40 |
| 2003/0213177 | A1 * | 11/2003 | Fitzgibbon | E05F 15/668 49/31 |
| 2003/0227370 | A1 * | 12/2003 | Brookbank | G07C 9/00182 340/5.7 |
| 2006/0132284 | A1 | 6/2006 | Murphy et al. | |
| 2008/0315988 | A1 | 12/2008 | Sikora et al. | |
| 2010/0085145 | A1 * | 4/2010 | Laird | E05F 17/00 340/5.7 |
| 2012/0112875 | A1 | 5/2012 | Heng et al. | |
| 2012/0255231 | A1 * | 10/2012 | Jenkins | H04W 52/0229 49/358 |
| 2012/0297681 | A1 * | 11/2012 | Krupke | E05F 15/60 49/324 |
| 2013/0042530 | A1 | 2/2013 | Leivenzon et al. | |
| 2013/0111813 | A1 * | 5/2013 | Rozgonyi | E05F 15/43 49/27 |
| 2013/0133262 | A1 | 5/2013 | Marchetto et al. | |
| 2014/0125499 | A1 * | 5/2014 | Cate | E05F 15/60 340/933 |
| 2014/0347162 | A1 | 11/2014 | Zueras et al. | |
| 2015/0015369 | A1 * | 1/2015 | Lamb | E05F 15/79 340/5.71 |
| 2015/0096693 | A1 * | 4/2015 | Fitzgibbon | E05F 15/42 160/7 |
| 2016/0177608 | A1 * | 6/2016 | Bruns | E05F 15/681 49/70 |
| 2017/0002595 | A1 * | 1/2017 | Keller, Jr. | E05F 15/40 |
| 2018/0179800 | A1 * | 6/2018 | Quaiser | E05F 15/668 |
| 2018/0247475 | A1 * | 8/2018 | Archbold | G07C 9/00309 |
| 2019/0085615 | A1 * | 3/2019 | Cate | G05B 15/00 |

* cited by examiner

WIRELESS INFRARED SAFETY SENSOR FOR GARAGE DOOR OPENER SYSTEM

FIELD OF INVENTION

The invention relates generally to the field of motorized garage door openers. In particular, the invention relates to wireless safety sensors for garage door openers and garage door opener with a wireless safety sensor.

INTRODUCTION

Safety sensor is one of the important safety elements within a garage door opener system. Underwriter Laboratory (UL), a global independent safety science company, has developed safety standards that require such safety sensor, which may be an infrared sensor, to constantly monitor for any obstacle in a door closing path during door closing cycle. If an obstacle is detected by the safety infrared sensor, the door must stop closing and return to the fully opened position in order to avoid any chance of severe injury or damages.

Typically, an infrared safety sensor requires two units. One is an infrared (IR) transmitter, and the other is an infrared receiver. Both units are connected to a garage door opener (GDO) main unit by electric wires. When the garage door is about to be closed, the GDO main unit will send a signal to the IR transmitter unit. In response, the IP transmitter will emit an infrared beam toward the IR receiver. The IR receiver will receive such beam signal if nothing is blocking the safety infrared beam. In response to receiving the safety beam signal, the IR receiver unit will send a "path clear" signal back to the GDO main unit, through another electric connection between the IR receiver and the GDO main unit, to indicate that the closing path of the garage door is not blocked.

The GDO will monitor the signal from the IR receiver when it is about to start a door closing cycle. If the infrared beam is interrupted while the door is closing, i.e., if the GDO main unit cannot receive a path clear signal from the IR receiver, the GDO needs to stop the door from closing immediately. Therefore, it is very important for the IR safety sensor to function properly and to have reliable connection between the IR safety sensor and the GDO's main unit; otherwise, the GDO may not operate safely.

However, a GDO's main unit is typically mounted on the ceiling towards one end of the garage, away from the door, and the two units of the infrared safety sensor are placed near the door, one on each side of the door. Therefore, wiring the two units and connecting them reliably to the GDO main unit usually takes quite some time. It is therefore desirable to have a safety sensor that can provide the same degree of reliability but easy to install.

The forgoing creates challenges and constraints for providing a safe and reliable safety sensor system for a garage door opener system. It is an object of the present invention to mitigate or obviate at least one of the above mentioned disadvantages.

SUMMARY OF INVENTION

The present invention is directed to a wireless safety sensor for garage door openers and a garage door opener system with a wireless safety sensor. The wireless safety sensor has a first wireless communication link with a main control unit of the garage door opener. The wireless safety sensor also has an internal wireless detection beam link, between a master sensor unit and a slave sensor unit. A power management system is provided to place the wireless safety sensor in a sleep mode for conserving power, and to wake up the wireless safety sensor on demand, i.e., when the garage door is closing, to detect any obstacles in the door's closing path, and to wake up a wireless circuitry of the wireless safety sensor periodically for verifying that the first wireless communication link has good signal quality.

When the GDO is about to close the door, i.e., to start a door closing cycle, the GDO's main control unit sends a status change or door closing signal to the wireless safety sensor. This signal wakes up the wireless safety sensor, which in turn detects if there is any obstacle in the door closing path. If no obstacle is detected, the wireless safety sensor sends a "path clear" signal to the GDO's main control unit. GDO's main control unit will start the door closing cycle until the door is fully closed, at which time, the GDO's main control unit will send another signal to the safety sensor to inform it the completion of the door closing cycle. During the door closing cycle, i.e., during the time when the garage door is driven towards the fully closed position, the wireless safety sensor keeps monitoring the door closing path and will send a "path blocked" signal to the GDO's main control unit if any obstacles in the door closing path is detected. If at any time during the door closing cycle (and/or prior to the start of the door closing cycle), such a "path blocked" signal is received by the GDO's main control unit or if the GDO's main control unit fails to receive the "path clear" signal, it will stop the door closing cycle or reverse the direction of the door's movement to drive it away from the fully closed position, in order to avoid hitting the obstacle.

In one aspect of the invention, there is provided a garage door opener system for opening and closing a garage door. The garage door opener system has a main control unit for controlling operation of an electric motor to move the garage door along a door closing path and a safety sensor unit communicating over a wireless connection with the main control unit. The safety sensor unit periodically transmits a wireless initiation signal to the main control unit to initiate verification of quality of the wireless connection and, upon detection of failure of meeting a pre-selected quality criteria, restores the quality to better than pre-set criteria. The safety sensor unit is configured to transmit a path blocked signal wirelessly upon detection of path blocked condition of the door closing path. The main control unit is configured to send a door closing signal over the wireless connection to the safety sensor unit before starting a door closing cycle to direct the safety sensor unit to commence detection of any path blocked condition and to stop or reverse the motion of the electric motor upon receiving the path blocked signal wirelessly from the safety sensor unit during the door closing cycle.

As a feature of this aspect of the invention, the safety sensor unit comprises a power management unit, the power management unit periodically switching the safety sensor unit from a lower power consumption sleep mode to a normal operation mode for transmitting the wireless initiation signal to the main control unit to initiate the verification. Optionally, the power management component switches the safety sensor unit from the sleep mode to the normal operation mode to commence the detection upon receiving the door closing signal from the main control unit, and the power management unit returns the safety sensor unit from the normal operation mode to the sleep mode upon expiry of a timer or upon receiving a cycle completion signal from the main control unit.

As another feature of this aspect of the invention, the main control unit comprises a main unit radio transceiver, the safety sensor unit comprises a sensor radio transceiver, and the radio communication between the main unit radio transceiver and the sensor radio transceiver provides the wireless connection.

As an option, the main unit radio transceiver and the sensor radio transceiver can be tuned to communicate in any one of a set of pre-selected frequency channels. Additionally, the safety sensor unit and the main control unit may cooperate to select from the set of pre-selected frequency channels a new channel different from a channel currently used by the sensor radio transceiver and to verify that communication quality over the new channel meets the pre-set criteria in order to restore the quality of the wireless connection. Alternatively, the safety sensor unit may select from the set of pre-selected frequency channels a new channel different from a channel currently used by the sensor radio transceiver and to verify that communication quality over the new channel meets the pre-set criteria in order to restore the quality of the wireless connection.

As another feature, the power management component may activate the sensor radio transceiver periodically to send the wireless initiation signal to initiate the verification of the quality of communication and to place the sensor radio transceiver in the sleep mode upon completion of the verification.

In yet another feature, the safety sensor unit comprises a safety sensor transmitter unit and a safety sensor receiver unit, and wherein, during the detection, the safety sensor transmitter unit transmits a blockable beam toward the sensor receiver unit, and the safety sensor receiver unit generates the path blocked signal for transmission to the main control unit upon failure of the sensor receiver unit receiving the blockable beam. As an option, the safety sensor transmitter unit connects to the safety sensor receiver unit over a signal connection, which may be either in radio frequency or infrared frequency range, and the safety sensor transmitter unit starts transmitting the blockable beam upon receiving a transmission start signal from the safety sensor receiver unit over the signal connection.

As yet another feature, the safety sensor unit comprises a master sensor unit which includes a master safety beam transceiver and a slave sensor unit which includes a slave safety beam transceiver. The power management unit comprises a master power component residing with the master sensor unit and a slave power component residing with the slave power unit. Upon receiving the door closing signal, the master power component switches the master safety sensor unit to the normal operation mode, and upon receiving the door closing signal from the main control unit or upon receiving a transmission start signal from the master safety sensor unit, the slave power component switches the slave safety sensor unit to the normal operation mode.

The master power component periodically may switch the master safety sensor unit from the sleep mode to the normal mode for the transmission of the wireless initiation signal and the verification of the quality of the wireless connection. The slave power component may switch the slave safety sensor unit periodically from the sleep mode to the normal mode for detecting the transmission start signal from the master safety sensor unit.

As another aspect of the invention, there is provided a garage door opener system for opening and closing a garage door that includes a main control unit for controlling operation of an electric motor to open or close the garage door, a master safety sensor unit and a slave safety sensor unit. The main control unit comprises a main unit microprocessor, a motor control unit for controlling energizing of the electric motor, and a main unit wireless circuitry in data communication with and controlled by the main unit microprocessor, the main unit wireless circuitry comprising a main unit transceiver. The master safety sensor unit comprises a sensor wireless circuitry which includes a sensor transceiver that communicates with the main unit transceiver wirelessly over a wireless connection, a master safety beam transceiver, and a sensor microprocessor in data communication with both the sensor wireless circuitry and the master safety beam transceiver. The sensor microprocessor is configured to periodically activate the sensor transceiver to transmit a wireless initiation signal to the main unit transceiver to initiate verification of quality of communication between the main unit transceiver and the sensor transceiver and to restore the quality to better than pre-set criteria if the quality is below the pre-set criteria. The slave safety sensor unit comprises a slave sensor microprocessor, and a slave safety beam transceiver in data communication with the slave sensor microprocessor. Upon the master sensor transceiver receiving a door closing signal from the main unit transceiver, the master sensor microprocessor directs the master safety beam transceiver to emit a start signal to the slave safety beam transceiver to direct the slave safety beam transceiver to start transmitting a safety detection signal.

As a feature of this aspect of the invention, the master sensor microprocessor directs the master sensor wireless transceiver to transmit a path clear signal to the main unit transceiver upon the master safety beam transceiver receiving the safety detection signal from the slave safety beam transceiver. As another feature, the master safety sensor unit further comprises a first power management circuitry and the slave safety sensor unit further comprises a second power management circuitry; and the start signal emitted by the master safety sensor unit is a wake-up signal, to cause the second power management circuitry to switch the slave safety sensor unit from a sleep mode to an active mode.

In yet another aspect of the invention, there is provided a wireless safety sensor for a garage door opener system, the garage door opener system comprising a main control unit for controlling operation of an electric motor to mobilize a garage door towards or away from a fully closed position along a door closing path. The main control unit includes a main unit radio transceiver for communication with the wireless safety sensor and for receiving obstacle detection alert signal from the wireless safety sensor. The wireless safety sensor comprises a sensor radio transceiver tunable to one or more frequency channels in a set of pre-selected frequency channels for wireless communication with the main unit radio transceiver, a microprocessor for controlling operations of the wireless safety sensor, a power management circuitry, and a detection unit. The power management circuitry cooperates with the microprocessor to place the sensor radio transceiver in one of a sleep mode and a normal operation mode, and places the sensor radio transceiver in the normal operation mode periodically to transmit a radio initiation signal to the main unit radio transceiver for initiating verification of and to verify communication quality of the wireless communication with the main unit radio transceiver. The sensor radio transceiver is also placed in the normal operation mode upon receiving a wireless door closing signal from the main unit radio transceiver. The detection unit comprises a master unit and a slave unit, the master unit being directable by at least one of the sensor radio transceiver and the microprocessor to emit a blockable detection beam to the slave unit and receive a return signal from the slave unit, the master unit providing an indication of no obstacle to the at least one of the sensor radio transceiver and the microprocessor upon receiving the return signal and providing an indication of obstacle detected to the at least one of the sensor radio transceiver and the microprocessor when fail to receive the return signal. The sensor radio transceiver is configured to transmit a wireless signal to the main control unit according to the indication received from the master unit.

As one feature of this aspect of the invention, if the quality of communication fails to meet a pre-set criteria, the sensor microprocessor cooperates with the main control unit to select from the set of pre-selected frequency channels a new channel different from a channel currently used by the sensor radio transceiver and to verify that communication quality over the new channel meets the pre-set criteria in order to restore the quality of the wireless connection. As another feature of this aspect of the invention, if the quality of communication fails to meet a pre-set criteria, the sensor microprocessor selects from the set of pre-selected frequency channels a new channel different from a channel currently used by the sensor radio transceiver and verifies that communication quality over the new channel meets the pre-set criteria in order to restore the quality of the wireless connection.

In other aspects the invention provides various combinations and subsets of the aspects, features and options described above and further described herein.

BRIEF DESCRIPTION OF DRAWINGS

For the purposes of description, but not of limitation, the foregoing and other aspects of the invention are explained in greater detail with reference to the accompanying drawings, in which.

DETAILED DESCRIPTION OF EMBODIMENTS

Figure 1A:
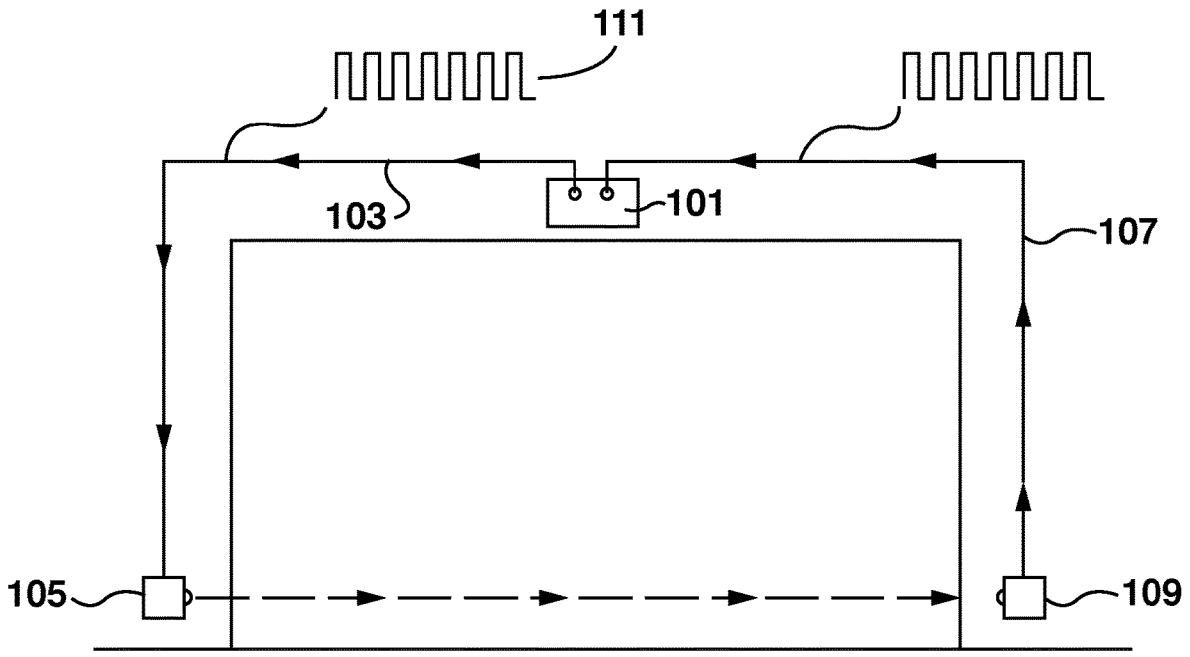
FIG. 1A illustrates a traditional safety infrared sensor arrangement.

The description which follows and the embodiments described therein are provided by way of illustration of an example, or examples, of particular embodiments of the principles of the present invention. These examples are provided for the purposes of explanation, and not limitation, of those principles and of the invention. In the description which follows, like parts are marked throughout the specification and the drawings with the same respective reference numerals.

FIG. 1A shows a traditional safety infrared sensor arrangement. A GDO head unit 101 is mounted near the ceiling of a garage. A signaling wire 103 connects a safety sensor transmitter 105 to the GDO head unit 101, and another signaling wire 107 connects a safety sensor receiver 109 to the GDO head unit 101. A safety signal 111, having a particular pattern as pre-determined or specified by design, is generated by the GDO head unit. This safety signal is converted to an IR signal, retaining the signal pattern, and transmitted by the infrared transmitter 105 to the infrared receiver 109, which is then converted back to electrical signal and sent back to the GDO head unit 101. If there is no obstacle between the IR transmitter and the IR receiver, the safety signal will complete a closed loop from the GDO head unit to the IR transmitter, continue to the IR receiver, and back to the GDO head unit. The GDO will receive the signal and its normal operation will not be stopped. If, however, the GDO head unit does not receive the safety signal, its door closing operation will be interrupted to prevent injury or damage.

Figure 1B:
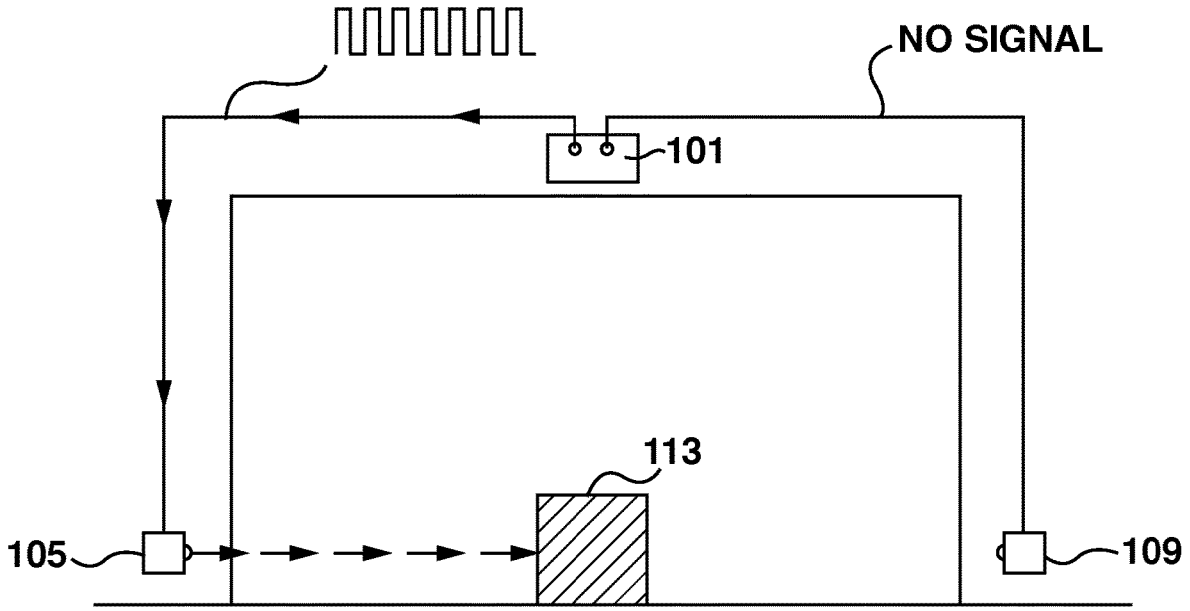
FIG. 1B shows an obstacle blocking the safety signal of the safety sensor shown in FIG. 1A.

In FIG. 1B, the safety signal is blocked by an obstacle 113 in the closing path of the closing door. With the obstacle in the closing path, the closing door, if it were to continue to close, will hit the obstacle during its downward travel, thus causing injuries or damages. However, because of the blockage, the IR receiver 109 cannot receive the safety signal from the IR transmitter 105 and the GDO head unit 101 also will not receive the safety signal from the IR receiver 109. The safety signal will not be able to complete the closed loop. The GDO will therefore stop the closing operation so that the door will not continue closing, thus avoiding hitting the obstacle 113.

The present invention is directed to an improved garage door opener system with a wireless safety sensor and a wireless safety sensor for a garage door opener system. The garage door opener system includes a main control unit for controlling operation of an electric motor to open or close the garage door, a safety sensor communicating with the main control unit over a wireless connection and a user command unit for receiving door close or door open commands from a user. The safety sensor periodically initiates a verification process to verify that the quality of the wireless connection meets a pre-selected criteria, and restores the quality if it fails to meet the criteria. The main control unit is configured to send a door closing signal to the safety sensor over the wireless connection upon receiving a door close command from the user command unit and to stop or reverse the motion of the electric motor upon receiving a path blocked signal from the safety sensor over the wireless connection.

Figure 2A:
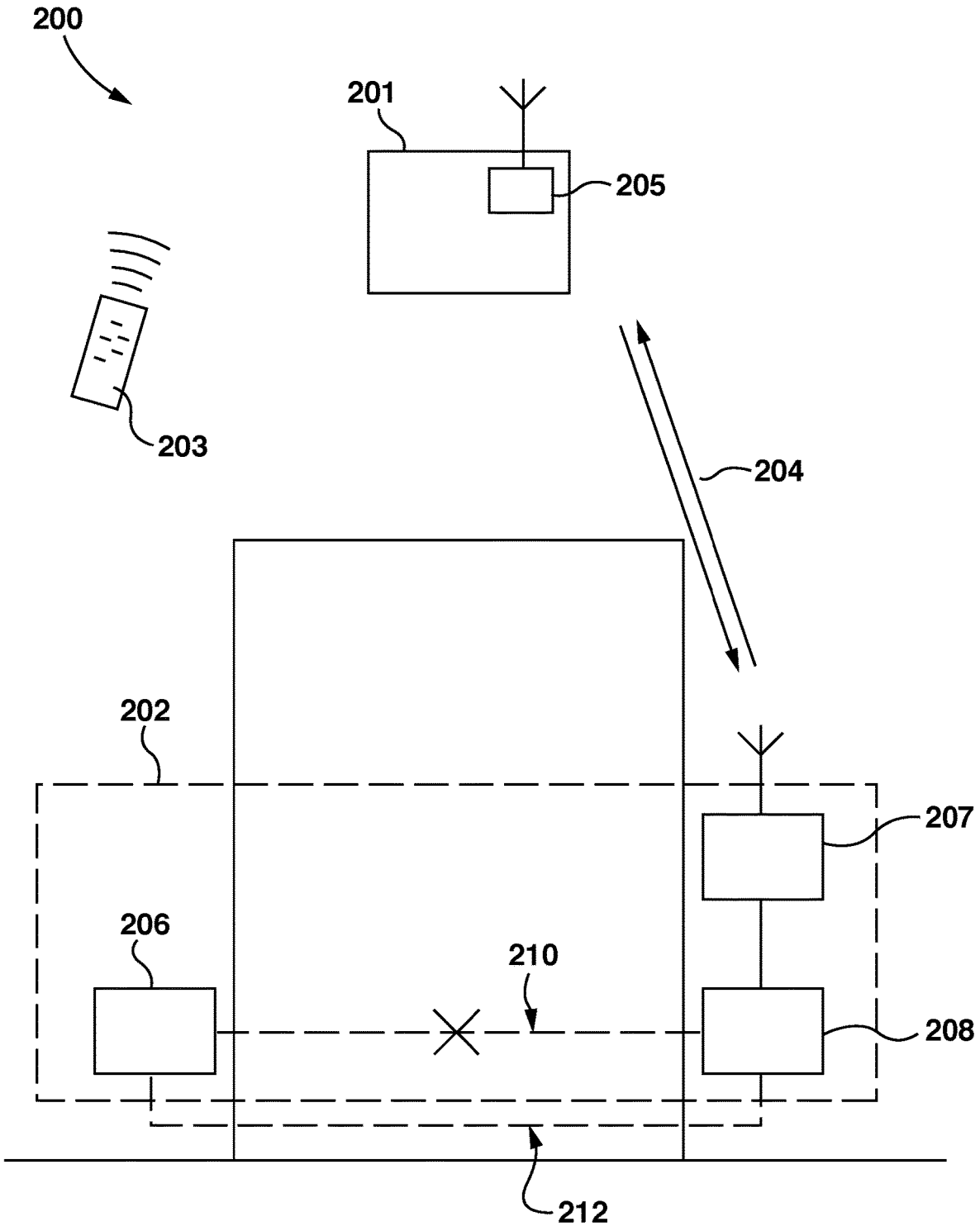
FIG. 2A illustrates a garage door opener system with a wireless safety sensor.

FIG. 2A illustrates a garage door opener system 200 with a wireless safety sensor, which includes a GDO's head unit, or main control unit 201, that communicates with a wireless safety sensor 202 over a wireless communication link 204 between the GDO's main control unit and the wireless safety sensor. A user uses a user command unit, such as a user remote 203, to enter door close and door open commands, which is then forwarded to the GDO's main control unit 201. The user command unit can communicate with GDO's main unit wirelessly in the case of user remote, or through a communication wire, in the case of a wall-wired control panel. As shown in FIG. 2A, main control unit 201 has a main unit wireless circuitry 205 that communicates with the wireless safety sensor through the wireless communication link 204. A sensor wireless circuitry 207 transmits signals to and receives signals from the main unit wireless circuitry 205, thereby establishing the wireless communication link.

When the user command unit receives a door close command from the user and the GDO is about to close the door, i.e., to start a door closing cycle, the GDO's main control unit 201 sends a status change or door closing signal to the wireless safety sensor 202. When this signal is received by the wireless safety sensor, it in turn detects if there is any obstacle in the door closing path, i.e., the path through which the door travels in the closing cycle. If no obstacle is detected, the wireless safety sensor 202 sends a "path clear" signal to the main control unit 201. The GOD's main control unit 201 will start the door closing cycle until the door is fully closed. The main control unit 201 may send another signal to the safety sensor at this time to inform the safety sensor the completion of the door closing cycle so that it will stop the blockage detection. Of course, the safety sensor may also stop detection upon expiry of a timer, which should be sufficiently longer than the duration of the door closing cycle. During the door closing cycle, i.e., during the time when the garage door is driven towards the fully closed position until fully closed, the wireless safety sensor 202 keeps monitoring the door closing path and will send a "path blocked" signal to the main control unit 201 if any obstacles in the door closing path is detected. If at any time during the door closing cycle (and/or prior to the start of the door closing cycle), such a "path blocked" signal is received by the GDO's main control unit 201 or if the main control unit fails to receive the "path clear" signal, it will not start the door closing cycle, or will stop the door closing cycle, or reverse the direction of the door's movement to drive it away from the fully closed position, as the case may be, in order to avoid hitting the obstacle. If the path is clear, i.e., not blocked, the wireless safety sensor 202 may periodically or continuously sends the "path clear" signal to the GOD's main control unit 201 to inform it the "path clear" condition. Alternatively, after a "path clear" signal is sent, the safety sensor may not send another signal until the "path blocked" condition is detected, at which time a "path blocked" signal is sent to the GDO's main control unit.

The wireless communication link 204 is used to establish communication between the GDO's main control unit 201 and the safety sensor, and may be in any suitable frequency range or take any suitable wave form, such as in the radio frequency, in the infrared range, as electromagnetic signals or as sound wave signals, and may be in mixed frequency ranges/waves, such as one wave or frequency in one direction and another in another direction. The main unit wireless circuitry 205 and the sensor wireless circuitry 207 in general each have a transmitter and a receiver, suitable for maintaining the communication link.

FIG. 2A illustrates a wireless communication link 204 entirely in the radio frequency ("RF") range. For such a wireless link, the main control unit's wireless circuitry 205 has at least a radio frequency transmitter and a radio frequency receiver, or a combined radio transceiver. To complete the communication link 204 with the GDO, the safety sensor also includes a sensor radio transceiver, being part of sensor wireless circuitry 207, to send radio signals to and receive radio signals from the GDO's main unit RF circuitry 205. Any signal from the GDO's main unit radio transceiver is received by sensor radio transceiver and further processed by the safety sensor unit. The sensor radio transceiver also sends signals from the safety sensor unit to the GDO's main control unit.

For a radio connection, maintaining connection quality is needed due to environmental radio interference. As will be appreciated, in today's typical residential environment, where the garage door opener is in use, there are often various kinds of radio interferences, such as Wi-Fi™, Bluetooth™, cordless phone, or any other wireless signals nearby. To overcome or reduce the impact of such interferences, sensor wireless circuitry 207 is configured to periodically verify the connection quality of the wireless connection 204 and changes connection parameters to restore connection quality where poor connection quality is detected.

Verification consumes power. The wireless safety sensor 202 has no wired connection to the GDO's main control unit 201 and thus is not powered by any power source connected to the GDO's main control unit 201. Batteries may be used to power the operation of the wireless safety sensor 202. To preserve battery energy, the wireless safety sensor 202 is placed in a sleep mode, i.e., a low energy consumption mode (compared to normal, full power mode), most of the time. The wireless safety sensor 202 is woken up periodically, i.e., placed in normal operation mode, for verifying the communication quality of the wireless communication link 204. If the communication quality fails to meet a pre-set standard, communication parameter, such as frequency, is adjusted or varied to restore the communication quality. Once the quality is verified to be satisfactory or restored to the pre-set standard, the wireless safety sensor 202 returns to sleep mode to preserve battery power until it is woken up again. One such example is described in detail below with reference to FIG. 4.

Wireless safety sensor 202 includes a detection unit, which may have two parts, namely a safety sensor transmitter unit 206 and a safety sensor receiver unit 208. This is more clearly illustrated in FIG. 2A. The safety sensor transmitter unit 206 and the safety sensor receiver unit 208 are installed on each side of the garage door and cooperate to detect any obstacle in the door closing path. They cooperate to detect the presence of an obstacle by, for example, detecting whether a blockable beam 210 from one detection unit to the other is interrupted. The blockable beam may be passive (such as reflective) or active. An active beam may be a safety detection beam or signal sent by the safety sensor transmitter unit 206 to the safety sensor receiver unit 208. It will be appreciated that for detecting blockage, the safety detection beam must be blockable by an object or a person, such as in the infrared frequency range or visible range, but not in radio frequency range. When blockage of the door closing path is detected, for example, if the safety sensor receiver unit 208 fails to receive the safety detection signal from the safety sensor transmitter unit 206, an alert, such as a "path blocked" signal, is generated and transmitted by the sensor wireless circuitry 207 to the GDO's main control unit 201 over the wireless communication link 204, to stop or reverse the door closing movement.

In addition to the detection beam 210 that links the safety sensor transmitter unit 206 and the safety sensor receiver unit 208, there is also a signal communication link or connection 212 that links the safety sensor transmitter unit 206 and the safety sensor receiver unit 208. Over this signal communication link 212, the safety sensor transmitter unit 206 and the safety sensor receiver unit 208 can send commands and/or status signals, among others, to each other. For example, the safety sensor receiver unit 208 can send "start" command or signal directing the safety sensor transmitter unit 206 to start transmitting the safety detection signal or beam 210, or to send "stop" command or signal directing the safety sensor transmitter unit 206 to stop transmission. This signal communication link 212 can be wired or wireless. A wireless signal communication link 212 can be in radio frequency, infrared or any other suitable frequency range or wave type with a suitable pair of transmitter and receiver. Conveniently, the safety sensor transmitter unit 206 may be replaced by a first safety sensor IR transceiver and the safety sensor receiver unit 208 may be replaced by a second safety sensor IR transceiver, such that the pair of IR transceivers provide both the detection function and the signal communication function, as will be further described.

Figure 2B:
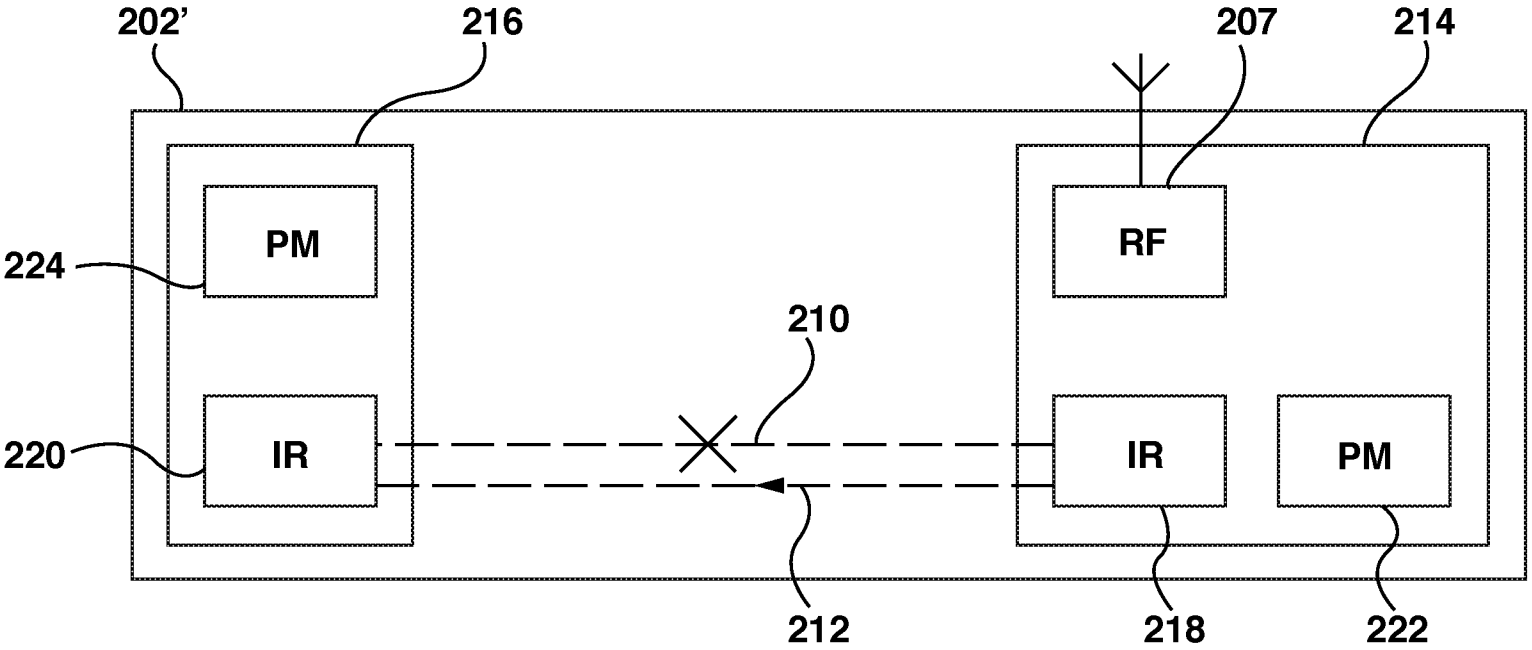
FIG. 2B illustrates an example of a wireless safety sensor that can be used in the garage door opener system shown in FIG. 2A.

In operation, the wireless safety sensor 202 is woken up when it receives a door closing signal (i.e., a wake-up signal) from the GDO's main control unit 201 for a wake-up period, which may be terminated by a door closing cycle completion signal. This door closing or wake-up signal may include information such as identification information of the garage door opener and a unique pattern to indicate that the door closing cycle is about to begin, among others. Similarly, the door closing cycle completion signal may include information such as identification information of the garage door opener and the unique pattern (or another unique pattern) to indicate that the door closing cycle is terminated, among others. When woken up by the wake-up signal from the main control unit 201, the wireless safety sensor 202 starts detecting, and continues detecting during the door closing cycle, for obstacles in the door closing path and informs the GDO's main control unit 201 upon detection of any obstacle. The detection stops and the wireless safety sensor returns to sleep mode when the door closing cycle completion signal is received. FIG. 2B illustrates a safety sensor unit 202' that includes a master safety sensor unit 214 and a slave safety sensor unit 216. The sensor wireless circuitry 207 which includes a sensor RF transceiver is shown as part of the master safety sensor unit 214, though it will be understood that the sensor RF transceiver 207 may also be separate from and residing with the master safety sensor unit 214. The master safety sensor unit 214 has a first infrared transceiver 218, or master safety IR beam transceiver. The slave safety sensor unit 216 has a second infrared transceiver 220, or slave safety IR beam transceiver. The safety detection beam or signal 210 sent from the second infrared transceiver 220 to the first infrared transceiver 218 thus provides the detection beam, as shown in FIG. 2B. On the other hand, infrared signals sent from the first infrared transceiver 218 to the second infrared transceiver 220 provide the internal signal connection. Thus, the first infrared transceiver 218 can be used to send an infrared signal to the slave safety sensor unit 216 and wait to receive a return signal from the slave safety sensor unit 216. The return signal may be one actively sent back by the slave safety sensor unit or reflected back from a reflector installed at the slave safety sensor unit. The second infrared transceiver 220 thus detects the infrared signal from the first infrared transceiver 218, and in response, actively sends back an infrared beam towards the first infrared transceiver as a return signal. During monitoring period, the second infrared transceiver 220 may also continuously, periodically, or otherwise (e.g., at randomly selected intervals) send the infrared beam towards the first infrared transceiver. The first infrared transceiver 218 in the master safety sensor unit 214 and the second infrared transceiver 220 in the slave safety sensor unit 216 thus provide both the communication 212 between the master safety sensor unit and the slave safety sensor unit and the detection beam 210 to detect any obstacle between the garage door's closing path.

Both the master safety sensor unit 214 and the slave safety sensor unit 216 are to be separately installed, not wired to the garage door opener's main control unit. Conveniently, they are separately powered by locally installed batteries or other local power sources. It is desirable that they each have their own separate power management units, to optimize the power consumption, thus maximize the battery life. To this end, the master safety sensor unit 214 has a first power management unit 222 to manage or control the power consumption of master safety sensor unit 214, such as the power consumption of the master RF transceiver 207 and the first infrared transceiver 218. Similarly, the slave safety sensor unit 216 has a second power management unit 224 to manage or control the power consumption of master safety sensor unit 216, such as the power consumption of the second infrared transceiver 220. In certain configurations, the slave sensor unit 216 may have its own RF transceiver, in which case the second power management unit 224 also can manage or control the power consumption of the slave sensor unit's RF transceiver. Of course, as described earlier, the internal signal communication link 212 may be wired, i.e., there may be a wire connection between the master safety sensor unit 214 and the slave safety sensor unit 216, in which case, additional electric wiring may be provided to allow the master safety sensor unit 214 and the slave safety sensor unit 216 to share the battery power so that only one of the power management units 222,224 may be necessary.

Figure 3A:
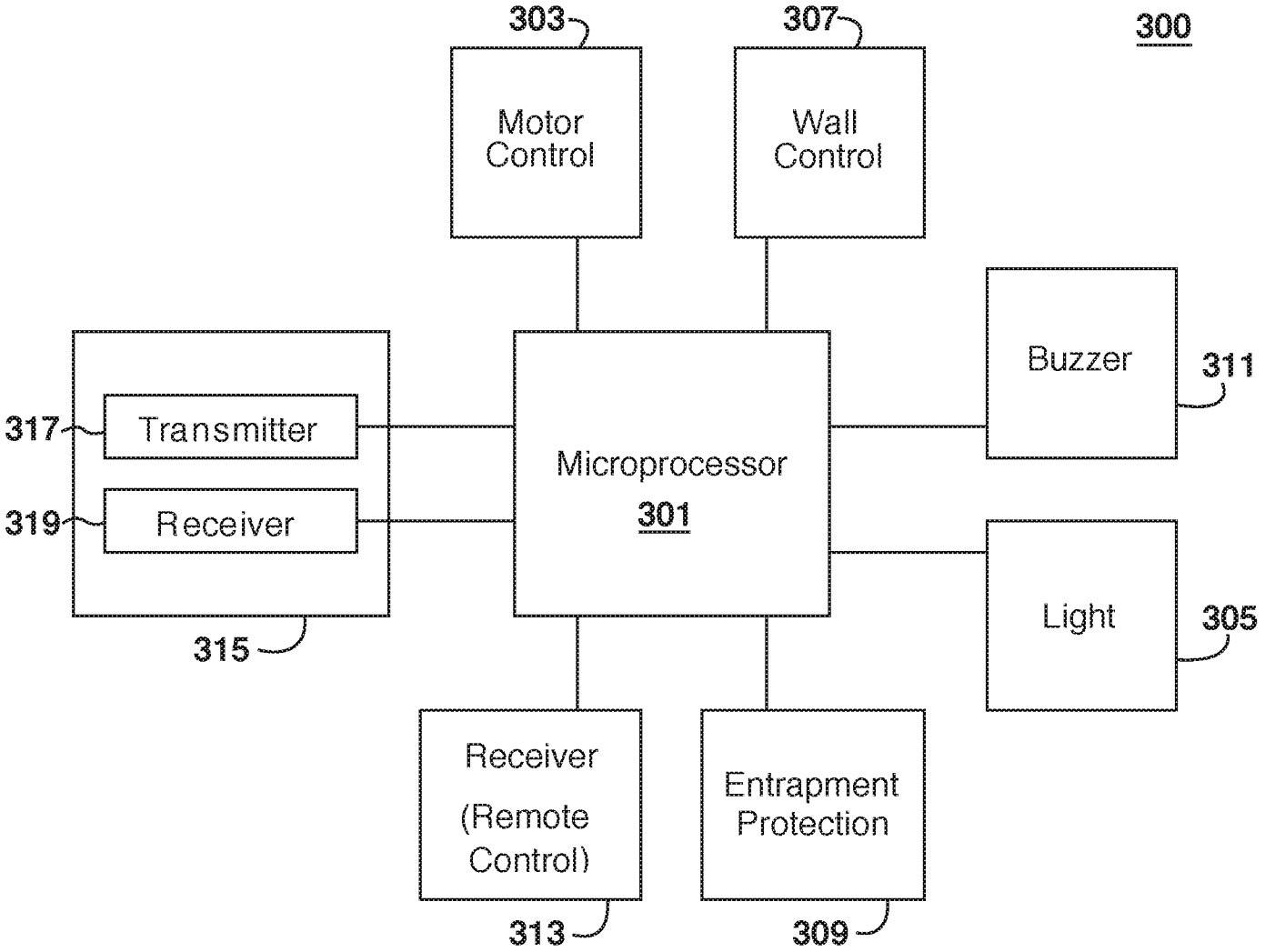
FIG. 3A illustrates in a block diagram a garage door opener system's control system.

FIG. 3A illustrates in a block diagram a garage door opener's control system 300. Microprocessor 301 controls all aspect of the operation of the garage door opener, including the operation of a motor control unit 303 for controlling energizing of an electric motor, to control and drive the opening and closing of the door; to turn on a light 305 when the garage door is in motion. A user command unit such as a wall control 307 allows user operation within the garage and usually includes functions such as opening and closing of the garage door, turning on and off the light 305, and to disable operations from all remote controls, sometimes referred as vacation lock. A garage door opener's control system 300 may also include components for other functional features. For example, most of garage door openers are also equipped with internal entrapment protection circuitry 309, which detects the increase in operating current caused by an obstruction when the door is closing. Often, several components of such a control system, such as microprocessor 301, internal entrapment protection circuitry 309, the motor control unit, are packaged in a main control unit, typically mounted on or near the ceiling, and which is often referred to as a head unit.

A buzzer 311 is also commonly found in today's garage door openers to support the unattended operation, which provides alert beeping when the garage door is being controlled remotely, such as from a smartphone. User command unit 307 may also take the form of, or include, wireless receiver 313, which is also commonly found in modern garage door openers, to support the function of controlling a garage door opener wirelessly within close proximity, such as using a handheld remote control or a keypad.

The garage door opener's control system 300 includes a wireless circuitry 315 that communicates in radio frequency with the wireless safety sensor. This wireless circuitry is generally included in the GDO's main control unit, where the microprocessor resides, but may also be included in the GDO's wall control unit. The wireless circuitry 315 includes a main unit radio transmitter 317 so that radio signals can be transmitted to safety sensor and a main unit radio receiver 319 so that radio signals from the wireless safety sensor can be received. Of course, main unit radio transmitter 317 and main unit radio receiver 319 may be combined into a single main unit radio transceiver. Further, as will be appreciated, a radio transceiver always includes a radio transmitter and a radio receiver. Additionally, wireless receiver 313 also has a radio receiver to communicate with handheld remote control. These two radio receivers can be combined into one radio receiver as well, without affecting their operation.

Figure 3B:
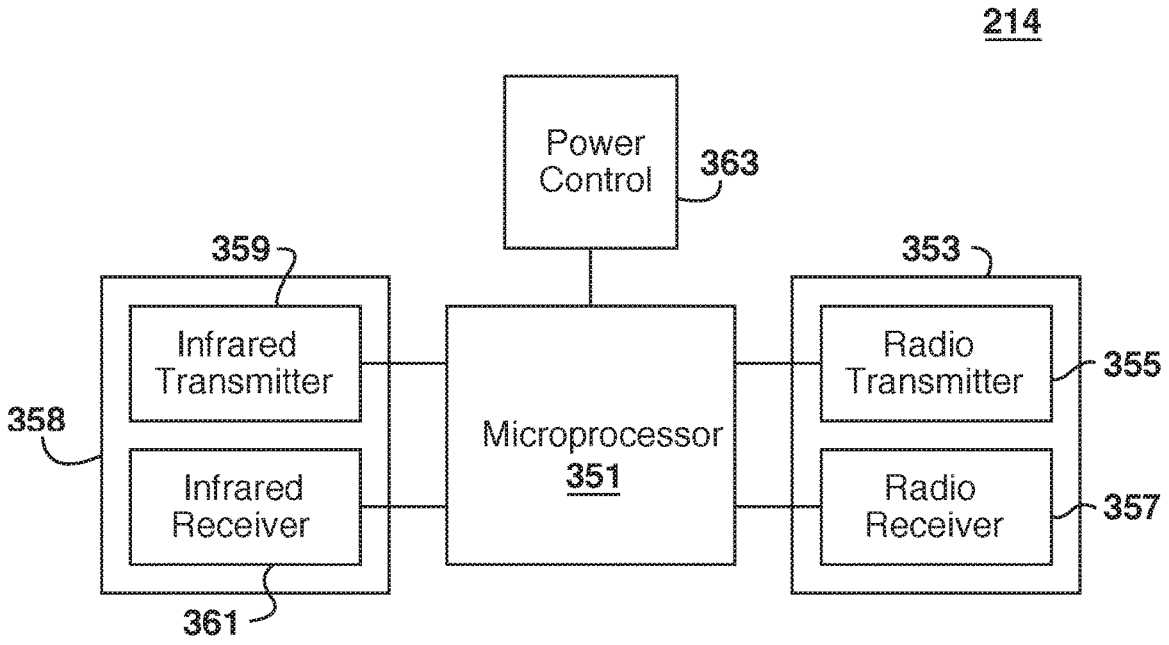
FIG. 3B is a block diagram illustrating the components of a particular master safety sensor unit of the wireless safety sensor shown in FIG. 2B.

FIG. 3B is a block diagram of a particular construction of a master safety sensor unit 214. The master safety sensor unit has a sensor microprocessor 351, and sensor wireless circuitry 353, which includes a sensor radio transmitter 355 and a sensor radio receiver 357. The sensor microprocessor 351 controls the operation of master unit's wireless circuitry 353 so that the master safety sensor unit 214 can communicate with the garage door opener main control unit through the sensor radio transmitter 355 and the sensor radio receiver 357. The sensor microprocessor also controls the communication with the slave safety sensor unit 216, through a master infrared transceiver 358, which includes a first infrared transmitter 359 and a first infrared receiver 361. The communication between master safety sensor unit 214 and slave safety sensor unit 216 or its interruption, may also used to detect any blockage of door closing path of the garage door.

The master safety sensor unit is connected to the GDO's main control unit (or head unit) via a wireless connection. Therefore, the master safety sensor unit 214 will need its own separate power source. Conveniently, the master safety sensor unit 214 can be powered by locally installed battery or batteries. In general, the batteries should provide enough power for an extended period of time so users do not need to replace the batteries too often. For most consumer electronics, it is expected to have battery life of one or two years and it is desired to use commonly available battery types such as conventional AA or AAA alkaline batteries. Having the safety sensor unit turned on continuously at its full power may not sustain such long battery life. A power management circuitry 363 is provided to reduce overall power consumption. As will be described in detail below, sensor microprocessor 351 also cooperates with the power management circuitry 363 to control the overall current consumption of the wireless safety sensor. When managed, i.e., controlled by power management circuitry, the wireless safety sensor is placed in a low current consumption mode, or sleep mode, most of the time, consuming least amount of current that is required. The wireless safety sensor consumes more current, i.e., in active mode, e.g., during the door closing cycle or when the sensor is verifying the wireless connection with the GDO's main control unit, and will return to sleep mode at other times. The operation of power management circuitry 363 will be described in more detail below with reference to FIG. 6.

Figure 3C:
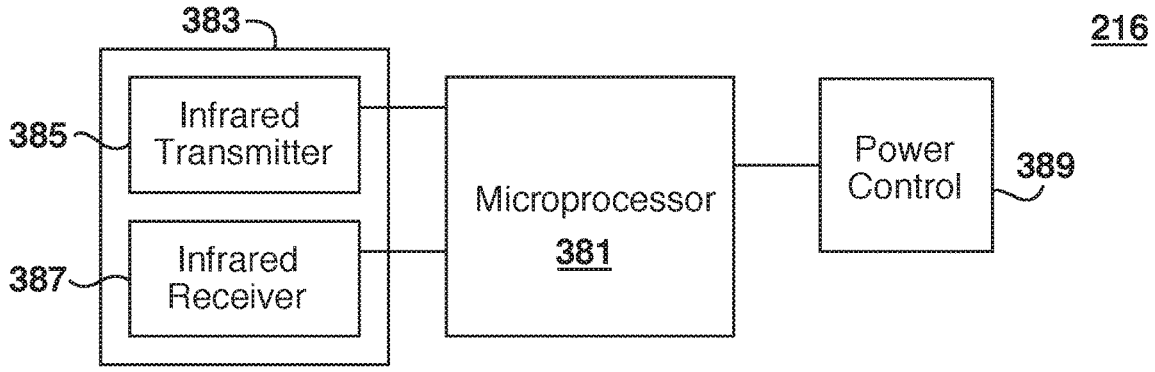
FIG. 3C is a block diagram illustrating the components of a particular slave safety sensor unit of the wireless safety sensor shown in FIG. 2B.

FIG. 3C is a block diagram illustrating an example of an active slave safety sensor unit 216, showing several components that are further described below. The slave safety sensor unit has a slave sensor microprocessor 381, a slave infrared transceiver 383, which includes a second infrared transmitter 385 and a second infrared receiver 387, and a second power management circuitry 389. The slave sensor microprocessor 381 controls the operation of the slave infrared transceiver 383. This slave infrared transceiver 383 communicates wirelessly in infrared with the master infrared transceiver 358 of the master safety sensor. Conveniently, the slave safety sensor unit is also powered by a battery or batteries, which may be managed by the second power management circuitry 389 (which may be in cooperation with slave sensor microprocessor 381) to minimize its overall current consumption. Just like the master safety sensor unit, it is in sleep mode most of the time, and is woken up by the master safety sensor unit 214, i.e., caused to be placed in active mode, during the door closing cycle.

Batteries are the power source for both master and slave safety sensor units in the examples illustrated in FIG. 3B and FIG. 3C. Maintaining an overall low power consumption of these sensor units help providing reasonable battery life. Maintaining low power consumption is not the only requirement. The power management circuitries also must meet several other requirements. First, the safety sensor is provided for safety reasons. Therefore, the wireless connection 204 between the garage door operator main control unit (or its head unit) and the safety sensor must be reliable. Any power saving scheme must not compromise this requirement. Similarly, the internal signal communication link 212 between the master safety sensor unit and the slave safety sensor unit integrates them into one complete safety sensor. The internal signal communication link 212 therefore also must be reliable during the door closing cycle. At other times, the sensor units must conserve battery energy as much as possible.

Figure 4:
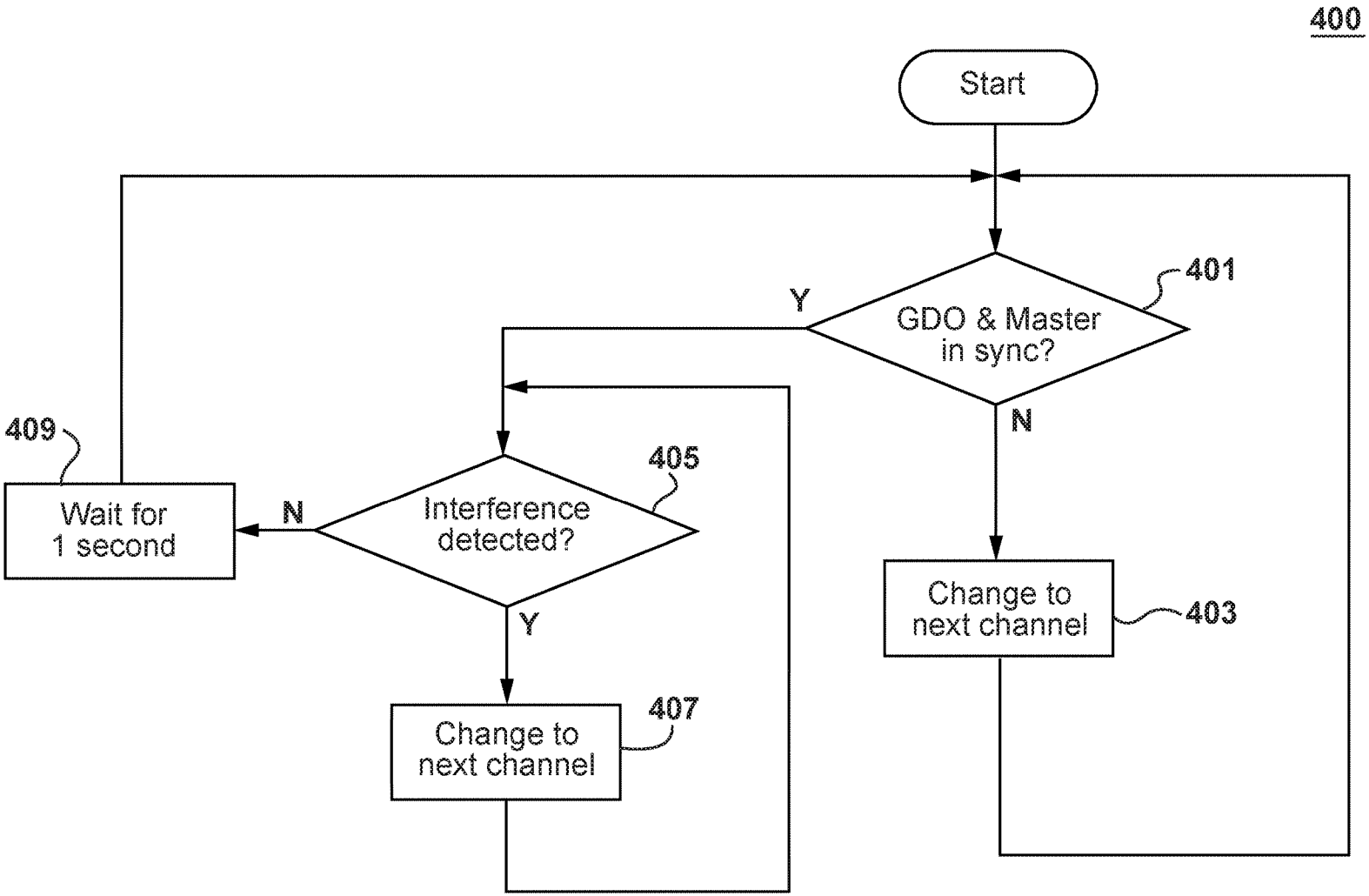
FIG. 4 illustrates a process for maintaining connection quality between the garage door opener system's main control unit and the wireless safety sensor unit.

Reliability of the wireless connection 204 may be adversely affected by environmental radio interferences. To overcome or reduce the impact of such interferences, the power management circuitry 363 periodically activates the master safety sensor unit 214, at least the master unit's wireless circuitry 353, in order to verify and maintain the wireless connection 204 in a reliable condition. One technique that can be employed for this purpose is a frequency hopping technique. A group of communication channels, each centered on a different radio frequency, is first selected. The first radio transceiver 315 of the GDO's main control unit and the sensor radio transceiver 353 of the master safety sensor unit can communicate in any one of this group of communication channels. A "quiet" communication channel among this group of communication channels is selected so that the two devices, in this case, the garage door opener's main control unit and the master safety sensor unit, can communicate with each other without being interfered. However, due to interference, a "quiet" communication channel may not be "quiet" at all times. The master safety sensor unit needs to be responsive at any time when the door is about to close, i.e., to receive a radio signal reliably. Verifying communication quality (and restoring it when required) consumes power. FIG. 4 illustrates a synchronization process 400 that maintains a balance between low current consumption and reliable communication link.

Referring to FIG. 4, when the garage door opener is not in a door closing sequence, the master safety sensor unit does not have continuous communication with the main control unit of the garage door opener. Instead, the master safety sensor unit will be activated only periodically (e.g., once every second as indicated in box 401) so that the GDO's main control unit can verify that the wireless communication link 204 at a specific channel can be established and has sufficiently good communication quality (which may be measured using some pre-set criteria). When activated, the master safety sensor unit, e.g., its wireless circuitry 207, will send a radio signal to the GDO's main control unit to initiate the verification process. As GDO's main control unit is powered by main power, its wireless circuitry 205 may be maintained in an "on" state at all times and will respond to the initiation signal from the master safety sensor unit to start the verification process upon receipt of the radio signal. Alternatively or in addition, GDO's main control unit may synchronize its internal clock with that of the master safety sensor unit and wait for the radio signal at or around the time when wireless circuitry 207 is scheduled to send the initiation signal.

Typically, establishing actual communication and verifying quality may take only 5 ms, which is only about 0.5% of the time the master safety sensor is functioning (assuming periodic verification at one second intervals). Verifying the connection generally consumes full power. At other times, i.e., when not verifying the quality of the connection or after good quality is satisfactorily verified, the master safety sensor unit does not need to consume full power, and may be placed in sleep mode. If the master safety sensor unit cannot communicate with the garage door opener using the current channel (401), the master sensor unit 214 will select another communication channel or scan the entire predefined group of channels if necessary, and find the new channel (403) that can be used for communicating with the garage door opener. If the garage door opener or the master sensor unit determines that its current channel has signal interference 405, e.g., by comparing communication quality, such as a signal to noise ratio, with the pre-set criteria, then the master sensor unit 214 and the control system 300 (or its main control unit) will together select another communication channel as pre-programmed, e.g., change to the next channel 407 within the predefined group of channels, or only the master sensor unit 214 will select another communication channel and scan the entire predefined group of channels if necessary, and determine if the new channel is a communication channel with good connection quality and/or insignificant signal interference (i.e., a "quiet channel", or meeting a pre-set standard). This search, namely switching to another channel and verifying the connection quality, will continue until a quiet channel is found 409. Once a quiet channel is found, the GDO's main control unit and the master safety sensor unit will be synchronized to this quiet channel. When the garage door opener needs to be closed, it can communicate with the master safety sensor unit immediately at the desired channel. As mentioned, this verification and searching routine takes place periodically, such as every 1 second, i.e., the verification and searching will start all over again one second after its conclusion 409.

The slave safety sensor 216 also has its own power management circuitry, a second power management circuitry 389. The second power management circuitry operates according to a slightly different power conservation protocol. The slave safety sensor 216 will also be in sleep mode most of the time, and it will wake up periodically to see if there is any wake-up signal from the master safety sensor 214.

Figure 5A:
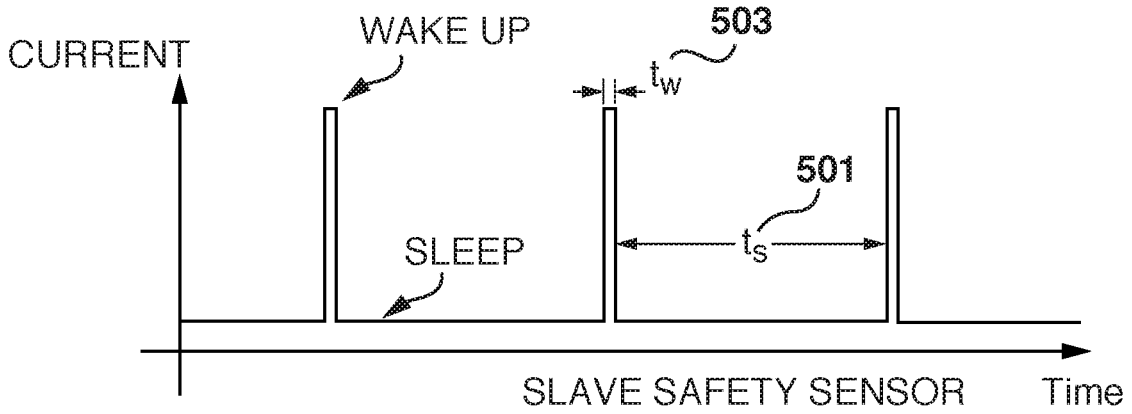
FIG. 5A illustrates in a timing diagram showing a slave sensor unit that wakes up periodically.

FIG. 5A is a timing diagram showing a slave safety sensor 216 that wakes up periodically. With appropriate selection of ratio of wake-up or polling interval and sleep interval, this periodic wake-up and polling may be configured to reduce energy consumption significantly without having practical effect on reliability. During the wake up interval, only the infrared receiver portion will be active, i.e., in functional mode. The second infrared transmitter 385 will remain in sleep mode to conserve power. Referring to FIG. 5A, the slave safety sensor unit is in sleep mode during the sleep interval, or $t_s$ interval 501 and wakes up during the wake-up interval, or $t_w$ interval 503. As is shown, the duration of $t_s$ is selected to be significantly longer than $t_w$, for example, at least 10 times longer. Therefore, the majority of the time is spent in standby mode, which has very low current consumption.

Figure 5B:
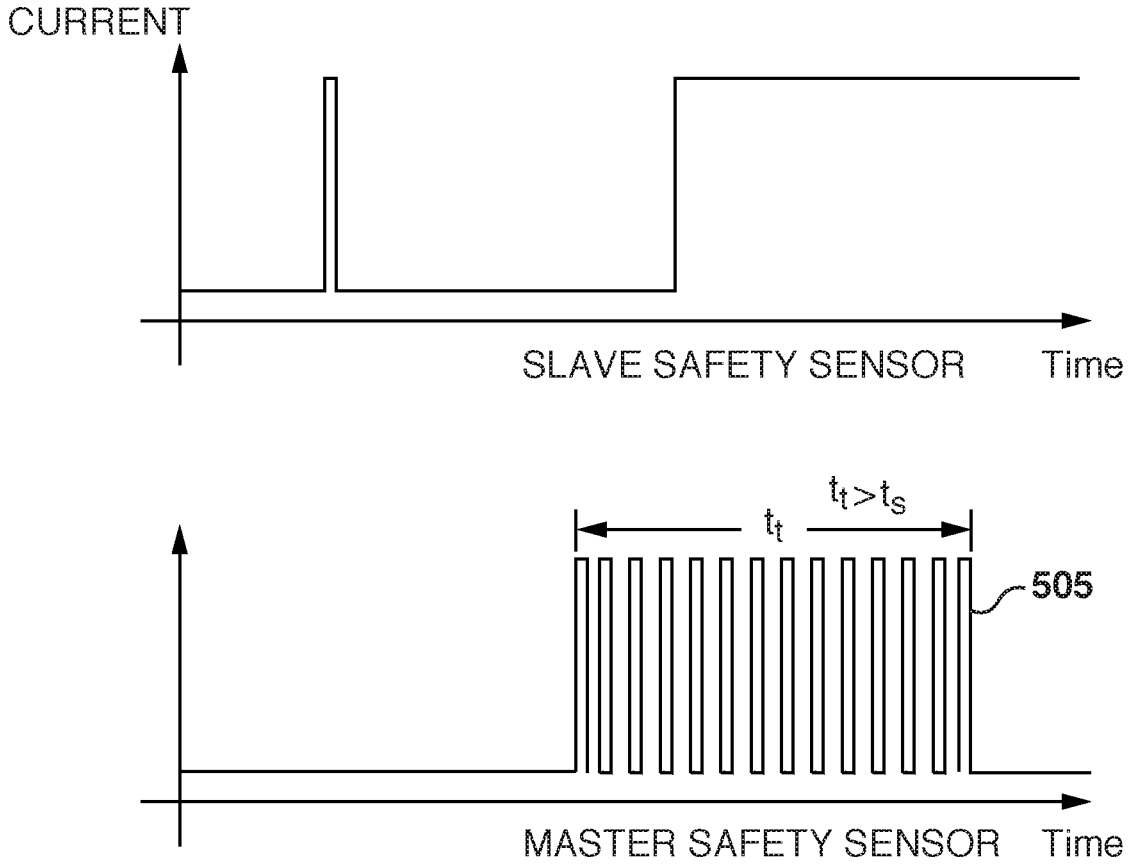
FIG. 5B illustrates in a timing diagram a slave sensor unit responding to a wake-up signal.

FIG. 5B is a timing diagram showing how the slave sensor would respond when it receives a wake-up signal from the master safety sensor during the switched-on interval 505. As shown, when a wake-up or start signal from the master safety sensor is received, the slave safety sensor is "woken up" or "switched on", i.e., placed in normal operation mode, or full power mode. In order to ensure the slave safety sensor can be woken up, the switched-on interval, i.e., the duration of the wake-up transmission signal $t_t$ must be longer than the sleep interval $t_s$.

In the foregoing, especially in reference to FIG. 5A and FIG. 5B, there is described an example of waking up the wireless safety sensor. According to this approach, the master sensor unit 214 wakes up the slave safety sensor unit 216 by sending a signal over the internal signal communication link 212, for example, an IR signal or a radio signal, after master sensor unit 214 is woken up by a radio signal, for example, from the GDO's main control unit. Of course, it will be understood by those skilled in the art that the order of waking up master sensor unit and slave sensor unit or how to wake up either unit may be implemented in any way suitable. For example, both the master safety sensor unit 214 and the slave safety sensor unit 216 may each have a radio signal receiver for receiving signals from the GDO's main control unit. With such an implementation, the GDO's main control unit 202 can wake up both sensor units at the same time by emitting a wake-up radio signal, to which both sensor units respond. Either way, when the slave safety sensor is placed in the normal operation mode, the slave safety sensor unit 216 may start sending, and the master safety sensor unit 214 may start detecting, the safety detection signal 212. Thus, the wireless safety sensor can immediately start detecting for any blockage of the door closing path, without having to send an internal wake-up signal to wake up the slave sensor unit. Both the master safety sensor unit 214 and the slave safety sensor unit 216 then can be returned to sleep mode by another radio frequency signal from the GDO's main control unit 202, namely a door closing cycle completion signal.

Figure 6:
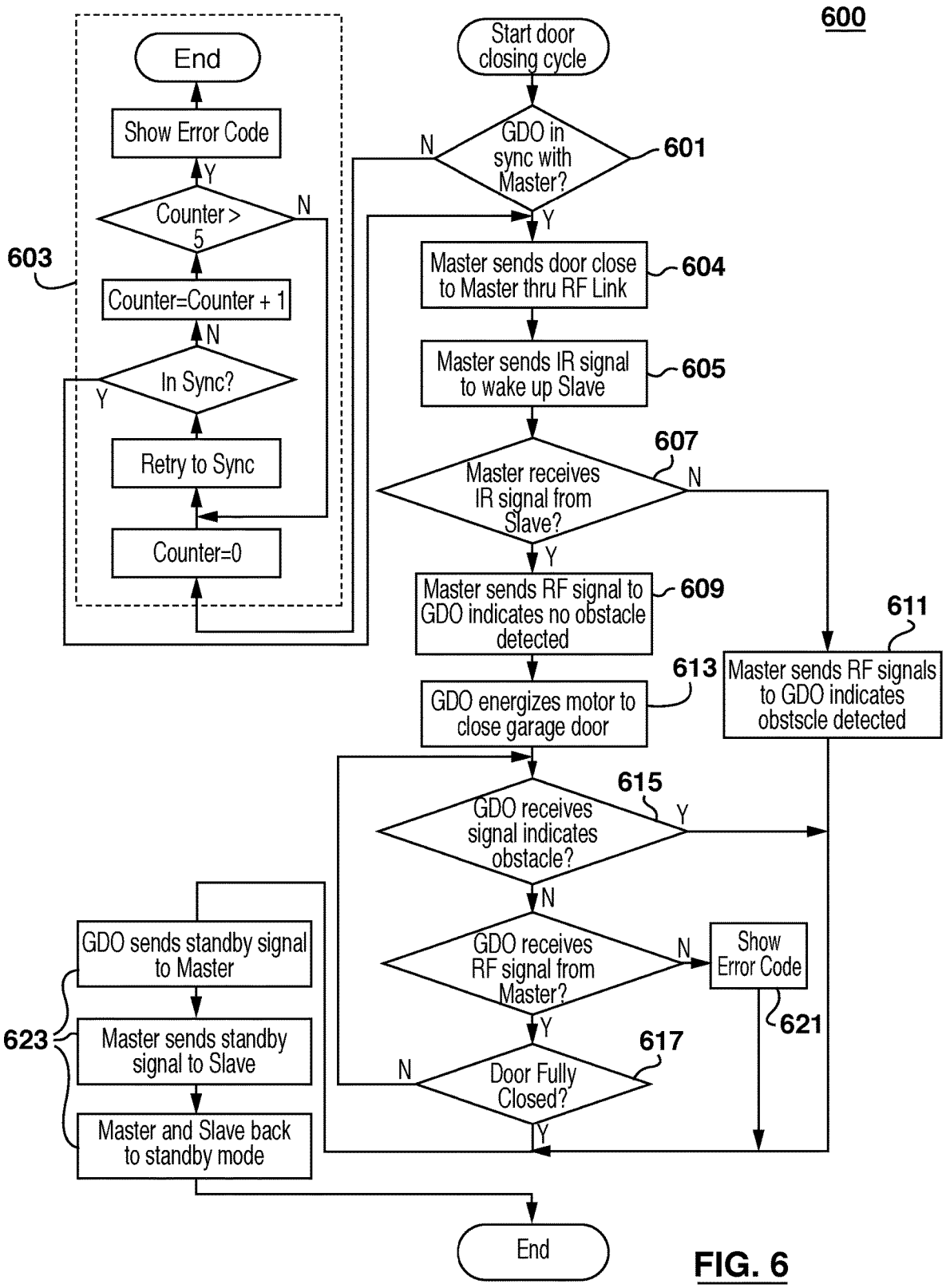
FIG. 6 shows a door closing procedure of a garage door opener system that includes a wireless safety sensor.

FIG. 6 shows a door closing procedure 600 of a garage door opener system that includes a two-part wireless safety sensor, namely a safety sensor that includes a master sensor unit and a slave sensor unit. When the garage door opener's main control unit receives a door closing command, e.g., from a handheld remote control, from a wall control or from a mobile device through the internet, main control unit first verifies that it is in sync 601 with the master safety sensor. As described earlier, the garage door opener's main control unit and the master safety sensor unit should be in sync all the time, even during standby, i.e., they should both have selected the same communication channel and that the quality of communication established using this synchronized channel is good (i.e., meet the pre-set criteria). The synchronization process described in reference to FIG. 4 may be used to synchronize a channel. If the communication channel is not synchronized between the garage door opener's main control unit and the master safety sensor unit or if the quality of communication of the synchronized channel fails to meet the pre-set criteria, the master safety sensor unit will try to synchronize for several times, the number of trials being pre-selected, e.g., 5 trials as shown in blocks 603, until the garage door opener's main control unit and master safety sensor are in sync, i.e., until they find a quiet communication channel. If the attempts failed after 5 trials, the master safety sensor unit will stop trying. Because the garage door opener's main control unit is not synchronized, e.g., not receiving the expected initialization signal from the master safety sensor unit or the quality of the communication remains low or unacceptable, the garage door opener's main control unit may display an error message to the user.

If the master safety sensor is in sync with the garage door opener, the GDO's main control unit will send a door close signal (block 604) to master safety sensor unit 214. The master safety sensor then in turn wakes up the slave safety sensor 216 by sending it a wake-up signal 605 over internal signal connection 212, which may be a radio signal or an infrared signal with a particular pattern. When this wake-up signal is received by the slave safety sensor, the slave safety sensor is placed in active mode, i.e., is in normal operation mode. Once in the wake-up mode, the slave safety sensor 216 will respond by sending back an infrared signal 210, which may be continuous, to the master safety sensor 214, until it is instructed to stop sending this infrared signal (e.g., when the door is fully closed, fully stopped or reversed its closing action). Thus, if there is no obstruction, the master safety sensor can and does receive 607 this infrared signal 210, which means no obstruction is detected. Then the master safety sensor 214 will send a radio signal, through sensor RF transceiver 207, to the garage door opener indicating obstruction is not detected 609 or the path is clear and the GDO's motor control unit 303 can energize the electric motor to close the door 613. If the master safety sensor 214 fails to receive this infrared signal, which suggests that obstruction is detected, the master safety sensor will send a radio signal to the garage door opener to terminate the door closing cycle 611.

The infrared signal for detecting obstacles sent from the slave safety sensor to the master safety sensor may be sent continuously, periodically or otherwise (such as at randomly selected intervals). For example, the master safety sensor may send a short infrared signal, such as a few milliseconds long in duration, to the slave safety sensor. The signal from the master safety sensor may include a command requesting a return signal from the slave safety sensor or the slave safety sensor may be programmed to respond to the signal from the master safety sensor, whether it includes a command, has a particular data pattern, or merely is in a particular frequency range, by sending back a returning signal. Thus, if the "command" signal from the master safety sensor 214 is received at the slave safety sensor 216, the slave safety sensor sends another short infrared signal 210, also a few milliseconds long in duration, to the master safety sensor. This process may repeat until the detection is no longer required, for example, when the door is closed. This cycle will also stop when an obstacle is detected, in which case the slave safety sensor will not send any signal because no signal would be received at the slave safety sensor, and the master safety sensor also will not send any further signal because no return signal from the slave safety sensor is received. Instead, the master safety sensor will send a path blocked signal over the wireless communication link 204 to the GDO's main control unit, so that the door closing operation may be stopped or reversed. As long as the closing path is clear the garage door opener will energize the electric motor to continue closing the garage door.

During the closing cycle, the master safety sensor unit 214 communicates with both the garage door opener's main control unit and the slave safety sensor 216, acting as a middle man to relay the "no-obstacle" information from the slave safety sensor to the garage door opener main control unit. If an obstacle is detected during the door closing cycle 615, the master safety sensor will send a "path blocked" signal to the garage door opener 611 and the garage door opener will stop the closing cycle immediately. Otherwise, the garage door opener will continue to monitor this "no-obstacle" condition until the door is fully closed, fully stopped or reversed its closing action 617.

As noted, the monitoring can be passive or active. For active monitoring, the master safety sensor can continuously send and the slave safety sensor can continuously receive the safety beam signal from the master safety sensor. Upon failure of receipt of this safety beam signal at the slave safety sensor, the slave safety sensor may either send a "path blocked" signal to the master safety sensor, or the master safety sensor will use the failure of receiving a "no-obstacle" signal from the slave safety sensor as an indication of "path blocked" condition. Alternatively, in the active monitoring mode, the master safety sensor and the slave safety sensor can alternate sending detection beam signals, such as infrared signals, to each other. For example, the master safety sensor can send a very short interval signal, e.g., a few milliseconds. Then, upon receipt, the slave safety sensor sends back a similarly very short interval signal, e.g., also a few milliseconds long. This process can be repeated during a door closing cycle until either blockage is detected or detection is no longer required.

For safety, if at any time when the door is closing, no radio signal is received by the garage door opener's main control unit 621, the garage door opener also stops the electric motor immediately to prevent the door from closing. An error code is then displayed to the user. When the door has reached the fully closed position, i.e., when the closing cycle is completed, the system will return to standby mode 623, and both master safety sensor unit 214 and slave safety sensor unit 216 will return to power conserving mode, i.e., sleep mode, as controlled by their respective power management circuitries. When the door closing cycle is terminated, either because the door closing cycle is forced to stop or fully reversed to the start position, or the closing cycle is completed, the main control unit will send a cycle completion signal 621, in response to which, both master safety sensor unit 214 and slave safety sensor unit 216 will stop the monitor operation (e.g., by stopping sending detection signals) and the power management circuitries will return both master safety sensor unit 214 and slave safety sensor unit 216 to power conserving mode, i.e., sleep mode. Alternatively, upon expiry of a timer set for a pre-selected length, e.g., 30 seconds, the monitoring will stop and the power management circuitries will return both master safety sensor unit 214 and slave safety sensor unit 216 to power conserving mode, i.e., sleep mode. Or, as a further alternative, the main control unit may also send a cycle completion signal 621 when the door closing cycle is terminated, prior to the expiry of the timer, to better conserve energy at the wireless safety sensor, e.g., the master safety sensor unit 214 and slave safety sensor unit 216.

Various embodiments of the invention have now been described in detail. Those skilled in the art will appreciate that numerous modifications, adaptations and variations may be made to the embodiments without departing from the scope of the invention, which is defined by the appended claims. The scope of the claims should be given the broadest interpretation consistent with the description as a whole and not to be limited to these embodiments set forth in the examples or detailed description thereof.

What is claimed is:

1. A garage door opener system for opening and closing a garage door, the garage door opener system comprising:

a main control unit for controlling operation of an electric motor to move the garage door along a door closing path; and a safety sensor unit communicating over a wireless connection with the main control unit, the safety sensor unit periodically transmitting a wireless initiation signal to the main control unit to initiate verification of quality of the wireless connection and, upon detection of failure of meeting a pre-set criteria, restoring the quality to be better than the pre-set criteria, the safety sensor unit being configured to transmit a path blocked signal wirelessly upon detection of path blocked condition of the door closing path, wherein the main control unit is configured to send a door closing signal over the wireless connection to the safety sensor unit before starting a door closing cycle to direct the safety sensor unit to commence detection of any path blocked condition and to stop the door closing cycle or to reverse a direction of movement of the garage door upon receiving the path blocked signal wirelessly from the safety sensor unit during the door closing cycle.

2. The garage door opener system of claim 1, wherein the safety sensor unit comprises a power management unit, the power management unit periodically switching the safety sensor unit from a lower power consumption sleep mode to a normal operation mode for transmitting the wireless initiation signal to the main control unit to initiate the verification.

3. The garage door opener system of claim 2, wherein the power management component switches the safety sensor unit from the sleep mode to the normal operation mode to commence the detection upon receiving the door closing signal from the main control unit.

4. The garage door opener system of claim 3, wherein the power management unit returns the safety sensor unit from the normal operation mode to the sleep mode upon expiry of a timer or upon receiving a cycle completion signal from the main control unit.

5. The garage door opener system of claim 2, wherein, the safety sensor unit comprises a master sensor unit and a slave sensor unit, the master sensor unit further comprising a master safety beam transceiver, the slave sensor unit further comprising a slave safety beam transceiver, the power management unit comprises a master power component residing with the master sensor unit and a slave power component residing with the slave power unit, and wherein upon receiving the door closing signal, the master power component switches the master safety sensor unit to the normal operation mode, and upon receiving the door closing signal from the main control unit or upon receiving a transmission start signal from the master safety sensor unit, the slave power component switches the slave safety sensor unit to the normal operation mode.

6. The garage door opener system of claim 5, wherein the master power component and the slave power component each return the master safety sensor unit and the slave safety sensor unit, respectively, from the normal operation mode to the sleep mode upon expiry of a timer or upon receiving a cycle completion signal from the main control unit.

7. The garage door opener system of claim 6, wherein the master power component returns the master safety sensor unit to the sleep mode upon receiving the cycle completion signal and the slave power component returns the slave safety sensor unit to the sleep mode upon receiving a stop command transmitted by the master safety sensor unit in response to the cycle completion signal.

8. The garage door opener system of claim 5, wherein the master power component periodically switches the master safety sensor unit from the sleep mode to the normal mode for the transmission of the wireless initiation signal and the verification of the quality of the wireless connection.

9. The garage door opener system of claim 5, wherein the slave power component switches the slave safety sensor unit periodically from the sleep mode to the normal mode for detecting the transmission start signal from the master safety sensor unit.

10. The garage door opener system of claim 1, wherein the main control unit comprises a main unit radio transceiver, the safety sensor unit comprises a sensor radio transceiver, and the radio communication between the main unit radio transceiver and the sensor radio transceiver provides the wireless connection.

11. The garage door opener system of claim 10, wherein the main unit radio transceiver and the sensor radio transceiver can be tuned to communicate in any one of a set of pre-selected frequency channels.

12. The garage door opener system of claim 11, wherein the safety sensor unit and the main control unit cooperate to select from the set of pre-selected frequency channels a new channel different from a channel currently used by the sensor radio transceiver and to verify that communication quality over the new channel meets the pre-set criteria in order to restore the quality of the wireless connection.

13. The garage door opener system of claim 11, wherein the safety sensor unit selects from the set of pre-selected frequency channels a new channel different from a channel currently used by the sensor radio transceiver and to verify that communication quality over the new channel meets the pre-set criteria in order to restore the quality of the wireless connection.

14. The garage door opener system of claim 10, wherein the power management component activates the sensor radio transceiver periodically to send the wireless initiation signal to initiate the verification of the quality of the wireless connection communication and to place the sensor radio transceiver in the sleep mode upon completion of the verification.

15. The garage door opener system of claim 1, wherein the safety sensor unit comprises a safety sensor transmitter unit and a safety sensor receiver unit, and wherein, during the detection, the safety sensor transmitter unit transmits a blockable beam toward the sensor receiver unit, and the safety sensor receiver unit generates the path blocked signal for transmission to the main control unit upon failure of the sensor receiver unit receiving the blockable beam.

16. The garage door opener system of claim 15, wherein the safety sensor transmitter unit connects to the safety sensor receiver unit over a signal connection and wherein the safety sensor transmitter unit starts transmitting the blockable beam upon receiving a transmission start signal from the safety sensor receiver unit over the signal connection.

17. The garage door opener system of claim 16, wherein the safety sensor transmitter unit stops transmitting the blockable beam upon failure of receiving another transmission signal from the safety sensor receiver unit over the signal connection, upon receiving a stop command from the master sensor unit over the signal connection, or upon expiry of a timer.

18. The garage door opener system of claim 16, wherein the safety sensor transmitter unit is energized by a power source that also energizes the safety sensor receiver unit.

19. The garage door opener system of claim 16, wherein the safety sensor receiver unit comprises a master wireless transmitter and the safety sensor transmitter unit comprises a slave wireless receiver, wireless signals transmitted by the master wireless transmitter and received at the slave wireless receiver provide the signal connection.

20. The garage door opener system of claim 19, wherein the master wireless transmitter is an infrared transmitter and the slave wireless receiver is an infrared receiver.

21. The garage door opener system of claim 19, wherein the master wireless transmitter is a radio frequency transmitter and the slave wireless receiver is a radio frequency receiver.

22. A garage door opener system for opening and closing a garage door, the garage door opener system comprising:

a main control unit for controlling operation of an electric motor to open or close the garage door, the main control unit comprising:

a main unit microprocessor;

a motor control unit for controlling energizing of the electric motor;

a main unit wireless circuitry in data communication with and controlled by the main unit microprocessor, the main unit wireless circuitry comprising a main unit transceiver;

a master safety sensor unit, the master safety sensor unit comprising:

a sensor wireless circuitry including a sensor transceiver, the sensor transceiver communicating with the main unit transceiver wirelessly over a wireless connection;

a master safety beam transceiver; and a sensor microprocessor in data communication with both the sensor wireless circuitry and the master safety beam transceiver, the sensor microprocessor being configured to periodically activate the sensor transceiver to transmit a wireless initiation signal to the main unit transceiver to initiate verification of quality of the wireless connection between the main unit transceiver and the sensor transceiver and to restore the quality to be better than a pre-set criteria if the quality is below the pre-set criteria; and a slave safety sensor unit, the slave safety sensor unit comprising:

a slave sensor microprocessor, and a slave safety beam transceiver in data communication with the slave sensor microprocessor;

wherein, upon the master sensor transceiver receiving a door closing signal from the main unit transceiver, the master sensor microprocessor directs the master safety beam transceiver to emit a start signal to the slave safety beam transceiver to direct the slave safety beam transceiver to start transmitting a safety detection signal.

23. The garage door opener system of claim 22, wherein the master sensor microprocessor directs the master sensor wireless transceiver to transmit a path clear signal to the main unit transceiver upon the master safety beam transceiver receiving the safety detection signal from the slave safety beam transceiver.

24. The garage door opener system of claim 22, wherein the master sensor transceiver transmits a path blocked signal to the main unit transceiver upon failure of the master safety beam transceiver receiving the safety detection signal from the slave safety beam transceiver.

25. The garage door opener system of claim 22, wherein the master safety sensor unit further comprises a first power management circuitry and the slave safety sensor unit further comprises a second power management circuitry; and the start signal emitted by the master safety sensor unit is a wake-up signal, to cause the second power management circuitry to switch the slave safety sensor unit from a sleep mode to an active mode.

26. The garage door opener system of claim 22, wherein the wireless connection is a radio frequency communication connection and wherein the main unit transceiver is a main unit radio transceiver and the sensor transceiver is a sensor radio transceiver.

27. The garage door opener system of claim 26, wherein the main unit radio transceiver and the sensor radio transceiver can be tuned to communicate in any one of a set of pre-selected frequency channels.

28. The garage door opener system of claim 27, wherein the sensor microprocessor and the main unit microprocessor cooperate to select from the set of pre-selected frequency channels a new channel different from a channel currently used by the sensor radio transceiver and to verify that the quality of the wireless connection over the new channel meets the pre-set criteria in order to restore the quality of the wireless connection.

29. The garage door opener system of claim 27, wherein the sensor microprocessor selects from the set of pre-selected frequency channels a new channel different from a channel currently used by the sensor radio transceiver and to verify that the quality of the wireless connection over the new channel meets the pre-set criteria in order to restore the quality of the wireless connection.

30. The garage door opener system of claim 27, wherein the sensor microprocessor and the first power management circuitry cooperate to activate the sensor radio transceiver periodically for verifying the quality of the wireless connection between the main unit radio transceiver and the sensor radio transceiver and to place the sensor radio transceiver in the sleep mode upon completion of the verification.

31. A wireless safety sensor for a garage door opener system, the garage door opener system comprising a main control unit for controlling operation of an electric motor to mobilize a garage door towards or away from a fully closed position along a door closing path, the main control unit including a main unit radio transceiver for communication with the wireless safety sensor and for receiving obstacle detection alert signal from the wireless safety sensor, the wireless safety sensor comprising:

a sensor radio transceiver tunable to one or more frequency channels in a set of pre-selected frequency channels for wireless communication with the main unit radio transceiver, a microprocessor for controlling operations of the wireless safety sensor, a power management circuitry, the power management circuitry cooperating with the microprocessor to place the sensor radio transceiver in one of a sleep mode and a normal operation mode, and the sensor radio transceiver being placed in the normal operation mode periodically to transmit a radio initiation signal to the main unit radio transceiver for initiating verification of and to verify quality of the wireless connection with the main unit radio transceiver and being placed in the normal operation mode upon receiving a wireless door closing signal from the main unit radio transceiver;

a detection unit, said detection unit comprising a master unit and a slave unit, the master unit being directable by at least one of the sensor radio transceiver and the microprocessor to emit a blockable detection beam to the slave unit and receive a return signal from the slave unit, the master unit providing an indication of no obstacle to the at least one of the sensor radio transceiver and the microprocessor upon receiving the return signal and providing an indication of obstacle detected to the at least one of the sensor radio transceiver and the microprocessor when fail to receive the return signal; and the sensor radio transceiver being configured to transmit a wireless signal to the main control unit according to the indication received from the master unit.

32. The wireless safety sensor of claim 31, wherein, if the quality of the wireless connection fails to meet a pre-set criteria, the sensor microprocessor cooperates with the main control unit to select from the set of pre-selected frequency channels a new channel different from a channel currently used by the sensor radio transceiver and to verify that the quality of the wireless connection over the new channel meets the pre-set criteria in order to restore the quality of the wireless connection.

33. The garage door opener system of claim 31, wherein, if the quality of the wireless connection fails to meet a pre-set criteria, the sensor microprocessor selects from the set of pre-selected frequency channels a new channel different from a channel currently used by the sensor radio transceiver and verifies that the communication quality of the wireless connection over the new channel meets the pre-set criteria in order to restore the quality of the wireless connection.

34. The wireless safety sensor of claim 31, wherein master unit comprises a master infrared transceiver and the slave unit comprises a slave infrared transceiver, the blockable detection beam is an infrared safety beam, and the slave infrared transceiver sends the infrared safety beam to the master infrared transceiver as the return signal.

* * * * *